US007721503B2

(12) United States Patent
Pervan et al.

(10) Patent No.: US 7,721,503 B2
(45) Date of Patent: May 25, 2010

(54) LOCKING SYSTEM COMPRISING A COMBINATION LOCK FOR PANELS

(75) Inventors: Darko Pervan, Viken (SE); Christian Boo, Kagerod (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 11/822,710

(22) Filed: Jul. 9, 2007

(65) Prior Publication Data

US 2008/0010937 A1 Jan. 17, 2008

Related U.S. Application Data

(60) Provisional application No. 60/830,677, filed on Jul. 14, 2006.

(51) Int. Cl.
*E04B 5/00* (2006.01)

(52) U.S. Cl. ..... 52/586.1; 52/177; 52/589.1; 52/747.1

(58) Field of Classification Search ..... 52/403.1, 52/578, 589.1, 590.2, 480, 506.1, 586.2, 52/584.1, 592.2, 551, 579, 581, 177, 747.1, 52/586.1

See application file for complete search history.

(56) References Cited

U.S. PATENT DOCUMENTS

| | | | | |
|---|---|---|---|---|
| 124,228 | A | 3/1872 | Stuart | |
| 1,723,306 | A * | 8/1929 | Sipe | 52/396.04 |
| 1,743,492 | A * | 1/1930 | Sipe | 403/297 |
| 1,787,027 | A | 12/1930 | Wasleff | |
| 1,809,393 | A | 6/1931 | Rockwell | |
| 1,902,716 | A | 3/1933 | Newton | |
| 1,925,070 | A | 8/1933 | Livezey | |
| 1,995,264 | A | 3/1935 | Mason | |
| 2,015,813 | A | 10/1935 | Nielsen | |
| 2,026,511 | A | 12/1935 | Storm | |
| 2,088,238 | A | 7/1937 | Greenway | |
| 2,089,075 | A | 8/1937 | Siebs | |
| 2,303,745 | A | 12/1942 | Karreman | |
| 2,430,200 | A | 11/1947 | Wilson | |
| 2,596,280 | A | 5/1952 | Nystrom | |
| 2,732,706 | A | 1/1956 | Friedman | |
| 2,740,167 | A | 4/1956 | Rowley | |

(Continued)

FOREIGN PATENT DOCUMENTS

| | | |
|---|---|---|
| CA | 991373 | 6/1976 |

(Continued)

OTHER PUBLICATIONS

U.S. Appl. No. 12/216,892, Pervan, et al.

(Continued)

*Primary Examiner*—Richard E Chilcot, Jr.
*Assistant Examiner*—Chi Q Nguyen
(74) *Attorney, Agent, or Firm*—Buchanan Ingersoll & Rooney PC

(57) ABSTRACT

A locking system for a floor panel includes a first connecting device, a second connecting device, and a third connecting device. The first connecting device includes a combination lock including an upwardly directed locking element configured to cooperate with a locking groove. The combination lock further including a flexible tongue in a displacement groove. The displacement groove and the flexible tongue of the combination lock are configured to cooperate with a tongue of a third connecting device.

4 Claims, 12 Drawing Sheets

U.S. PATENT DOCUMENTS

| | | | | |
|---|---|---|---|---|
| 2,863,185 | A | 12/1958 | Riedi | |
| 2,865,058 | A | 12/1958 | Andersson et al. | |
| 3,023,681 | A | 3/1962 | Worson | |
| 3,077,703 | A | 2/1963 | Bergstrom | |
| 3,325,585 | A | 6/1967 | Brenneman | |
| 3,378,958 | A | 4/1968 | Parks et al. | |
| 3,436,888 | A | 4/1969 | Ottosson | |
| 3,517,927 | A | 6/1970 | Kennel | |
| 3,526,071 | A | 9/1970 | Watanabe | |
| 3,535,844 | A | 10/1970 | Glaros | |
| 3,554,850 | A | 1/1971 | Kuhle | |
| 3,572,224 | A | 3/1971 | Perry | |
| 3,579,941 | A | 5/1971 | Tibbals | |
| 3,720,027 | A | 3/1973 | Christensen | |
| 3,731,445 | A | 5/1973 | Hoffmann et al. | |
| 3,742,669 | A | 7/1973 | Mansfeld | |
| 3,760,547 | A | 9/1973 | Brenneman | |
| 3,849,235 | A | 11/1974 | Gwynne | |
| 3,919,820 | A | 11/1975 | Green | |
| 4,100,710 | A | 7/1978 | Kowallik | |
| 4,107,892 | A | 8/1978 | Bellem | |
| 4,113,399 | A | 9/1978 | Hansen, Sr. et al. | |
| 4,169,688 | A | 10/1979 | Toshio | |
| 4,299,070 | A | 11/1981 | Oltmanns et al. | |
| 4,426,820 | A * | 1/1984 | Terbrack et al. | 52/590.1 |
| 4,512,131 | A | 4/1985 | Laramore | |
| 4,599,841 | A * | 7/1986 | Haid | 52/396.04 |
| 4,819,932 | A | 4/1989 | Trotter, Jr. | |
| 5,007,222 | A | 4/1991 | Raymond | |
| 5,135,597 | A | 8/1992 | Barker | |
| 5,148,850 | A | 9/1992 | Urbanick | |
| 5,247,773 | A | 9/1993 | Weir | |
| 5,295,341 | A | 3/1994 | Kajiwara | |
| 5,344,700 | A | 9/1994 | McGath et al. | |
| 5,348,778 | A | 9/1994 | Knipp et al. | |
| 5,349,796 | A | 9/1994 | Meyerson | |
| 5,465,546 | A | 11/1995 | Buse | |
| 5,548,937 | A | 8/1996 | Shimonohara | |
| 5,577,357 | A | 11/1996 | Civelli | |
| 5,598,682 | A | 2/1997 | Haughian | |
| 5,618,602 | A | 4/1997 | Nelson | |
| 5,694,730 | A | 12/1997 | Del Rincon et al. | |
| 5,755,068 | A | 5/1998 | Ormiston | |
| 5,860,267 | A | 1/1999 | Pervan | |
| 5,899,038 | A | 5/1999 | Stroppiana | |
| 5,950,389 | A | 9/1999 | Porter | |
| 6,052,960 | A | 4/2000 | Yonemura | |
| 6,065,262 | A | 5/2000 | Motta | |
| 6,173,548 | B1 | 1/2001 | Hamar et al. | |
| 6,182,410 | B1 | 2/2001 | Pervan | |
| 6,203,653 | B1 | 3/2001 | Seidner | |
| 6,216,409 | B1 * | 4/2001 | Roy et al. | 52/589.1 |
| 6,254,301 | B1 | 7/2001 | Hatch | |
| 6,314,701 | B1 | 11/2001 | Meyerson | |
| 6,332,733 | B1 | 12/2001 | Hamberger et al. | |
| 6,358,352 | B1 | 3/2002 | Schmidt | |
| 6,363,677 | B1 * | 4/2002 | Chen et al. | 52/586.1 |
| 6,385,936 | B1 | 5/2002 | Schneider | |
| 6,418,683 | B1 | 7/2002 | Martensson et al. | |
| 6,450,235 | B1 | 9/2002 | Lee | |
| 6,490,836 | B1 | 12/2002 | Moriau et al. | |
| 6,505,452 | B1 | 1/2003 | Hannig et al. | |
| 6,536,178 | B1 | 3/2003 | Pålsson et al. | |
| 6,553,724 | B1 | 4/2003 | Bigler | |
| 6,576,079 | B1 | 6/2003 | Kai | |
| 6,591,568 | B1 | 7/2003 | Pålsson | |
| 6,601,359 | B2 | 8/2003 | Olofsson | |
| 6,617,009 | B1 | 9/2003 | Chen et al. | |
| 6,647,689 | B2 | 11/2003 | Pletzer et al. | |
| 6,647,690 | B1 | 11/2003 | Martensson | |
| 6,711,869 | B2 | 3/2004 | Tychsen | |
| 6,722,809 | B2 | 4/2004 | Hamberger et al. | |
| 6,729,091 | B1 | 5/2004 | Martensson | |
| 6,763,643 | B1 | 7/2004 | Martensson | |
| 6,769,219 | B2 * | 8/2004 | Schwitte et al. | 52/592.1 |
| 6,802,166 | B1 | 10/2004 | Gerhard | |
| 6,851,237 | B2 | 2/2005 | Niese et al. | |
| 6,854,235 | B2 | 2/2005 | Martensson | |
| 6,865,855 | B2 | 3/2005 | Knauseder | |
| 6,874,291 | B1 | 4/2005 | Weber | |
| 6,880,305 | B2 | 4/2005 | Pervan et al. | |
| 6,880,307 | B2 | 4/2005 | Schwitte et al. | |
| 6,898,913 | B2 | 5/2005 | Pervan | |
| 6,918,220 | B2 | 7/2005 | Pervan | |
| 6,922,964 | B2 | 8/2005 | Pervan | |
| 7,040,068 | B2 | 5/2006 | Moriau et al. | |
| 7,051,486 | B2 * | 5/2006 | Pervan | 52/586.1 |
| 7,086,205 | B2 | 8/2006 | Pervan | |
| D528,671 | S | 9/2006 | Grafenauer | |
| 7,127,860 | B2 | 10/2006 | Pervan et al. | |
| 7,152,383 | B1 | 12/2006 | Wilkinson, Jr. et al. | |
| 7,188,456 | B2 | 3/2007 | Knauseder | |
| 7,251,916 | B2 | 8/2007 | Konzelmann et al. | |
| 7,275,350 | B2 | 10/2007 | Pervan | |
| 7,328,536 | B2 | 2/2008 | Moriau et al. | |
| 7,356,971 | B2 | 4/2008 | Pervan | |
| 7,377,081 | B2 * | 5/2008 | Ruhdorfer | 52/588.1 |
| 7,386,963 | B2 | 6/2008 | Pervan | |
| 7,398,625 | B2 | 7/2008 | Pervan | |
| 7,454,875 | B2 | 11/2008 | Pervan et al. | |
| 7,533,500 | B2 | 5/2009 | Morton et al. | |
| 7,584,583 | B2 | 9/2009 | Bergelin et al. | |
| 7,614,197 | B2 | 11/2009 | Nelson | |
| 7,617,651 | B2 | 11/2009 | Grafenauer | |
| 2002/0007608 | A1 | 1/2002 | Pervan | |
| 2002/0007609 | A1 | 1/2002 | Pervan | |
| 2002/0014047 | A1 | 2/2002 | Thiers | |
| 2002/0031646 | A1 | 3/2002 | Chen et al. | |
| 2002/0056245 | A1 | 5/2002 | Thiers | |
| 2002/0083673 | A1 | 7/2002 | Kettler et al. | |
| 2002/0092263 | A1 | 7/2002 | Schulte | |
| 2002/0095894 | A1 | 7/2002 | Pervan | |
| 2002/0112429 | A1 | 8/2002 | Niese et al. | |
| 2002/0112433 | A1 | 8/2002 | Pervan | |
| 2002/0170257 | A1 | 11/2002 | McLain et al. | |
| 2002/0170259 | A1 | 11/2002 | Ferris | |
| 2002/0178674 | A1 | 12/2002 | Pervan | |
| 2003/0024199 | A1 | 2/2003 | Pervan et al. | |
| 2003/0024200 | A1 | 2/2003 | Moriau et al. | |
| 2003/0037504 | A1 | 2/2003 | Schwitte et al. | |
| 2003/0101674 | A1 | 6/2003 | Pervan et al. | |
| 2003/0180091 | A1 | 9/2003 | Stridsman | |
| 2003/0188504 | A1 | 10/2003 | Eisermann | |
| 2003/0196397 | A1 | 10/2003 | Niese et al. | |
| 2003/0196405 | A1 | 10/2003 | Pervan | |
| 2004/0031227 | A1 | 2/2004 | Knauseder | |
| 2004/0060255 | A1 | 4/2004 | Knauseder | |
| 2004/0068954 | A1 | 4/2004 | Martensson | |
| 2004/0168392 | A1 | 9/2004 | Konzelmann et al. | |
| 2004/0182036 | A1 | 9/2004 | Sjoberg et al. | |
| 2004/0200175 | A1 | 10/2004 | Weber | |
| 2004/0211143 | A1 | 10/2004 | Hanning | |
| 2004/0261348 | A1 | 12/2004 | Vulin | |
| 2005/0055943 | A1 | 3/2005 | Pervan | |
| 2005/0160694 | A1 | 7/2005 | Pervan | |
| 2005/0166502 | A1 | 8/2005 | Pervan | |
| 2005/0193677 | A1 | 9/2005 | Vogel | |
| 2005/0208255 | A1 | 9/2005 | Pervan | |
| 2005/0210810 | A1 | 9/2005 | Pervan | |
| 2005/0235593 | A1 | 10/2005 | Hecht | |
| 2005/0252130 | A1 | 11/2005 | Martensson | |
| 2005/0268570 | A2 | 12/2005 | Pervan | |
| 2006/0032168 | A1 | 2/2006 | Thiers et al. | |
| 2006/0070333 | A1 | 4/2006 | Pervan | |

| | | | |
|---|---|---|---|
| 2006/0075713 | A1 | 4/2006 | Pervan |
| 2006/0101769 | A1 | 5/2006 | Pervan et al. |
| 2006/0196139 | A1 | 9/2006 | Pervan |
| 2006/0236642 | A1 | 10/2006 | Pervan |
| 2006/0260254 | A1 | 11/2006 | Pervan |
| 2006/0283127 | A1 | 12/2006 | Pervan |
| 2007/0006543 | A1 | 1/2007 | Engstrom |
| 2007/0011981 | A1 | 1/2007 | Eisermann |
| 2007/0028547 | A1 | 2/2007 | Grafenauer et al. |
| 2007/0151189 | A1 | 7/2007 | Yang |
| 2007/0175143 | A1 | 8/2007 | Pervan et al. |
| 2007/0175144 | A1 | 8/2007 | Hakansson |
| 2007/0175148 | A1 | 8/2007 | Bergelin et al. |
| 2007/0175156 | A1 | 8/2007 | Pervan et al. |
| 2008/0000179 | A1 | 1/2008 | Pervan et al. |
| 2008/0000180 | A1 | 1/2008 | Pervan |
| 2008/0000182 | A1 | 1/2008 | Pervan |
| 2008/0000185 | A1 | 1/2008 | Duernberger et al. |
| 2008/0000186 | A1 | 1/2008 | Pervan et al. |
| 2008/0000187 | A1 | 1/2008 | Pervan |
| 2008/0000188 | A1 | 1/2008 | Pervan |
| 2008/0000189 | A1 | 1/2008 | Pervan |
| 2008/0000194 | A1 | 1/2008 | Pervan |
| 2008/0000417 | A1 | 1/2008 | Pervan |
| 2008/0005989 | A1 | 1/2008 | Pervan |
| 2008/0005992 | A1 | 1/2008 | Pervan |
| 2008/0005997 | A1 | 1/2008 | Pervan |
| 2008/0005998 | A1 | 1/2008 | Pervan |
| 2008/0005999 | A1 | 1/2008 | Pervan |
| 2008/0008871 | A1 | 1/2008 | Pervan |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0028713 | A1 | 2/2008 | Pervan et al. |
| 2008/0034701 | A1 | 2/2008 | Pervan |
| 2008/0034708 | A1 | 2/2008 | Pervan |
| 2008/0041007 | A1 | 2/2008 | Pervan et al. |
| 2008/0041008 | A1 | 2/2008 | Pervan |
| 2008/0060308 | A1 | 3/2008 | Pervan |
| 2008/0066415 | A1 | 3/2008 | Pervan |
| 2008/0104921 | A1 | 5/2008 | Pervan et al. |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0134614 | A1 | 6/2008 | Pervan et al. |
| 2008/0155930 | A1 | 7/2008 | Pervan et al. |
| 2008/0172971 | A1 | 7/2008 | Pervan |
| 2008/0216434 | A1 | 9/2008 | Pervan |
| 2008/0216920 | A1 | 9/2008 | Pervan |

FOREIGN PATENT DOCUMENTS

| | | | |
|---|---|---|---|
| CA | 2456513 | A1 | 2/2003 |
| DE | 2 159 042 | A1 | 6/1973 |
| DE | 33 43 601 | A1 | 6/1985 |
| DE | 42 15 273 | A1 | 11/1993 |
| DE | 42 42 530 | A1 | 6/1994 |
| DE | 196 01 322 | A1 | 5/1997 |
| EP | 0 013 852 | A1 | 8/1980 |
| EP | 0 652 340 | A1 | 5/1995 |
| EP | 0 974 713 | A1 | 1/2000 |
| EP | 1 120 515 | A1 | 8/2001 |
| EP | 1 146 182 | A2 | 10/2001 |
| EP | 1 308 577 | A2 | 5/2003 |
| EP | 1 650 375 | A1 | 4/2006 |
| FR | 2 810 060 | A1 | 12/2001 |
| GB | 2 051 916 | A | 1/1981 |
| JP | 6-146553 | A | 5/1994 |
| JP | 7-310426 | A | 11/1995 |
| JP | 10-219975 | A | 8/1998 |
| WO | WO 94/26999 | A1 | 11/1994 |
| WO | WO 96/27719 | A1 | 9/1996 |
| WO | WO 96/27721 | A1 | 9/1996 |
| WO | WO 97/47834 | A1 | 12/1997 |
| WO | WO 98/38401 | A1 | 9/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/47841 | | 8/2000 |
| WO | WO 01/02672 | A1 | 1/2001 |
| WO | WO 01/07729 | A1 | 2/2001 |
| WO | WO 01/51732 | A1 | 7/2001 |
| WO | WO 01/66877 | A1 | 9/2001 |
| WO | WO 01/98604 | A1 | 12/2001 |
| WO | WO 02/055809 | A1 | 7/2002 |
| WO | WO 02/055810 | A1 | 7/2002 |
| WO | WO 03/016654 | A1 | 2/2003 |
| WO | WO 03/025307 | A1 | 3/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/020764 | A1 | 3/2004 |
| WO | WO 2004/079130 | A1 | 9/2004 |
| WO | WO 2004/083557 | A1 | 9/2004 |
| WO | WO 2005/054599 | A1 | 6/2005 |
| WO | WO 2006/043893 | A1 | 4/2006 |
| WO | WO 2006/050928 | A1 | 5/2006 |

OTHER PUBLICATIONS

U.S. Appl. No. 12/362,977, Pervan, et al.

Pervan, et al., U.S. Appl. No. 12/216,892, entitled "Mechanical Locking of Floor Panels With a Flexible Tongue," Jul. 11, 2008.

Boo, et al., U.S. Appl. No. 12/362,977, entitled "Mechanical Locking of Floor Panels," Jan. 30, 2009.

International Search Report issued in PCT/SE2007/000635 (Published as WO 2008/008016 A1), Nov. 6, 2007, Swedish Patent Office, Stockholm, SE.

U.S. Appl. No. 12/518,594, Pervan, et al.

Pervan, et al., U. S. Appl. No. 12/518,584, entitled "Mechanical Locking of Floor Panels," filed in the U. S. Patent and Trademark Office on Jun. 10, 2009.

U.S. Appl. No. 12/518,584, Pervan et al.

Pervan, et al., U. S. Appl. No. 12/518,584, entitled, "Mechanical Locking of Floor Panels," filed in the U. S. Patent and Trademark Office on Jun. 10, 2009.

Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.

* cited by examiner

Prior Art

Prior Art

LOCKING SYSTEM COMPRISING A COMBINATION LOCK FOR PANELS

CROSS-REFERENCE TO RELATED APPLICATIONS

The present application claims the benefit of U.S. application Ser. No. 11/770,771, which was filed on Jun. 29, 2007, and claims the benefit of U.S. Provisional Application Ser. No. 60/830,677, which was filed on Jul. 14, 2006, and the entire contents thereof are incorporated herein by reference.

FIELD OF INVENTION

The invention generally relates to the field of floor panels with mechanical locking systems with a flexible and displaceable tongue.

BACKGROUND

In particular, yet not in a restrictive manner, the disclosure concerns a locking system for a floor panel and a set of floor panels mechanically joined to preferably a floating floor. However, the disclosure is as well applicable to building panels in general. More particularly, the disclosure relates to the type of mechanically locking systems comprising a flexible or partly flexible tongue and/or a displaceable tongue, in order to facilitate the installation of building panels.

A floor panel of this type is presented in WO2006/043893, which discloses a floor panel with a locking system comprising a locking element cooperating with a locking groove, for horizontal locking, and a flexible tongue cooperating with a tongue groove, for locking in a vertical direction. The flexible tongue bends in the horizontal plane during connection of the floor panels and makes it possible to install the panels by vertical folding or solely by vertical movement. By "vertical folding" is meant a connection of three panels where a first and second panel are in a connected state and where a single angling action connects two perpendicular edges of a new panel, at the same time, to the first and second panel. Such a connection takes place for example when a long side of the first panel in a first row is already connected to a long side of a second panel in a second row. The third panel is then connected by angling to the long side of the first panel in the first row. This specific type of angling action, which also connects the short side of the new panel and second panel, is referred to as "vertical folding". It is also possible to connect two panels by lowering a whole panel solely by vertical movement against another panel.

DEFINITION OF SOME TERMS

In the following text, the visible surface of the installed floor panel is called "front face", while the opposite side of the floor panel, facing the sub floor, is called "rear face". The edge between the front and rear face is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane.

By "joint" or "locking system" are meant co-acting connecting means, which connect the floor panels vertically and/or horizontally. By "mechanical locking system" is meant that joining can take place without glue. Mechanical locking systems can in many cases also be combined with gluing. By "integrated with" means formed in one piece with the panel or factory connected to the panel.

By a "flexible tongue" is meant a separate tongue which has a length direction along the joint edges and which is forming a part of the vertical locking system and could be displaced horizontally during locking. The tongue could for example be bendable or have a flexible and resilient part in such a way that it can bend along its length and spring back to its initial position.

By "angling" is meant a connection that occurs by a turning motion, during which an angular change occurs between two parts that are being connected, or disconnected. When angling relates to connection of two floor panels, the angular motion takes place with the upper parts of joint edges at least partly being in contact with each other, during at least part of the motion.

OBJECTS AND SUMMARY

The present disclosure discloses a locking system and a set of floor panels or a floating flooring, which provides for new embodiments according to different aspects offering respective advantages. Useful areas for the disclosure are floor panels of any shape and material e.g. laminate, wood, HDF, veneer or stone.

According to a first object, the disclosure provides for locking system for a floor panel comprising a first connecting device. The first connecting device comprises a combination lock configured to lock horizontally and vertically to a second and third connecting devices of a second and third connecting device, respectively. The combination lock comprises a locking element for cooperating with a locking grove of the second and third connecting device, for the horizontal locking. Further more, the combination lock comprises a flexible tongue and displacement groove, configured to cooperate with a flexible tongue groove of the second floor panel and a tongue of a third floor panel.

As the locking system for a floor panel according to the first object is provided with a flexible and displaceable tongue, displaceable in a displacement groove and configured to cooperate with a flexible tongue groove as well as with a tongue, this offers several advantages. A first advantage is that it is possible to connect one side of a floor panel with a first connecting device to two different connecting devices. A second advantage is that a strong joint is provided and a third that the height position between the floor panels, in the short edge to long edge joint is improved.

A locking system for a floor panel of this type is known from WO2006/043893, as mentioned above, and discloses a bow shaped flexible tongue bendable in the length direction. The drawback of this locking system is that if it is used on a joint between a long and short side it weakens the joint. The first panel has a long edge of an angling type (see FIG. 10*a*), comprising a locking element and a tongue groove. To facilitate the connection to a short side of a second panel, the short side is provided with a flexible tongue and a displacement groove. This results in a very thin section between the bottom of the displacement groove and the locking groove. The thin section makes the joint weak and it's likely that this thin section will crack when the joint is put under load.

Preferably, the length of the displacement groove is at least equal to the sum of the width of the flexible tongue and the tongue.

Preferably, the width of the entrance E of the displacement groove is at least equal to the thickness TT of the tongue.

Preferably, the flexible tongue is displaceable via the tongue.

Preferably, the panels joined are of A and B type, with mirror inverted connecting devices.

Preferably, the flexible tongue has a straight outer edge and an inner edge with bendable protrusions.

According to a second object, the disclosure provides for a set of floor panels comprising the combination lock above at two of the edges of a first panel, configured to cooperate with the second connecting device of a second panel and with a third connecting device of a third panel. The set of floor panels has the same advantage as mentioned above and it is provides for easy installation of advanced patterns.

All references to "a/an/the [element, device, component, means, step, etc]" are to be interpreted openly as referring to at least one instance of said element, device, component, means, step, etc., unless explicitly stated otherwise.

DESCRIPTION OF PREFERRED EMBODIMENTS OF THE INVENTION

As represented in FIGS. 1-3 and 7-12, the invention relates to a locking system and a set of floor panels with a displaceable tongue.

Figure 1A:
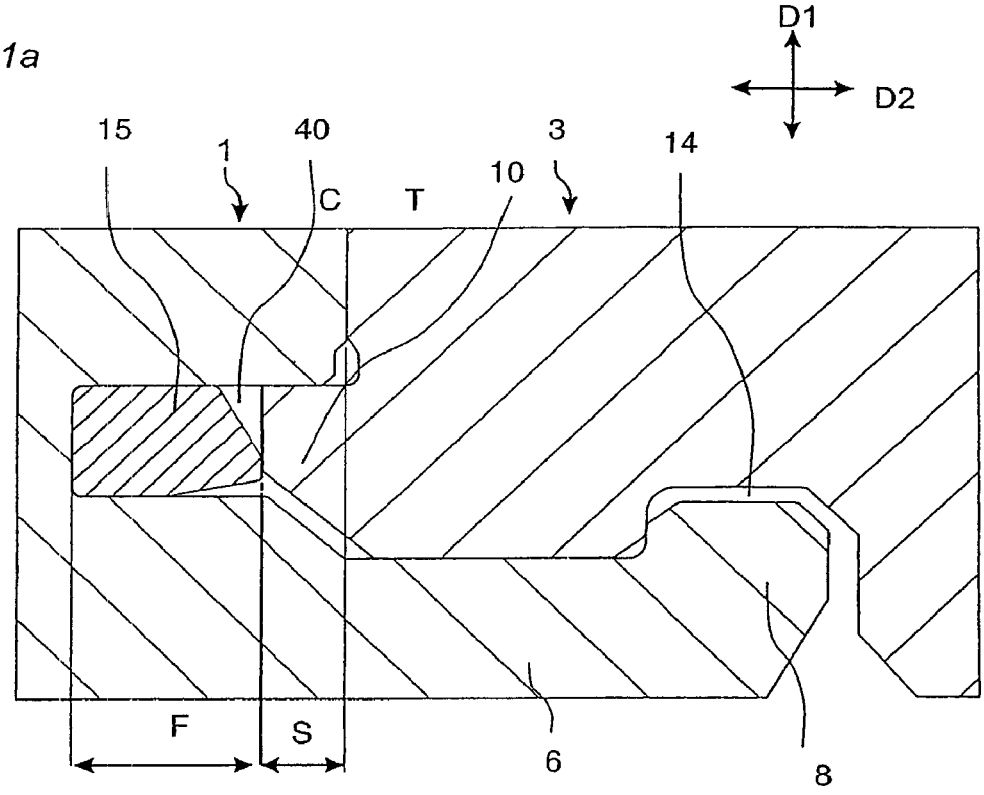
FIGS. 1*a-b* illustrate a locking system according to an embodiment of the invention.
Figure 1B:
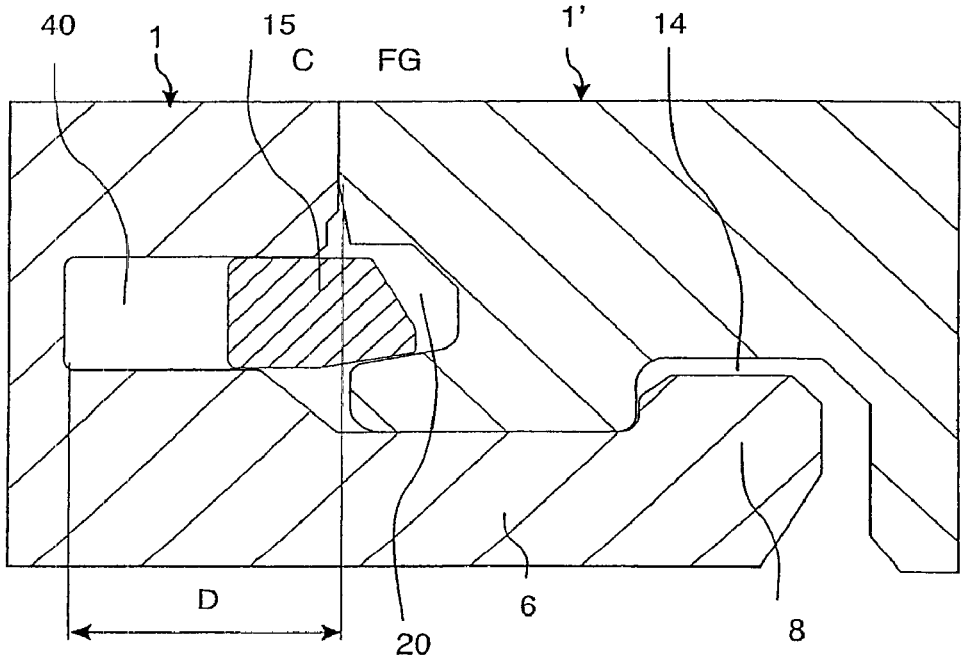

FIGS. 1*a-b* show an embodiment of a locking system according to the invention. FIG. 1*b*, shows the locking system in a state wherein a first connecting device, a combination lock C, of a first panel 1, is connected to a second connecting device FG of a second panel 1'. The combination lock comprises a locking strip 6 and an upwardly projected locking element 8 cooperating with a locking groove 14 of the second connecting device for horizontal locking. Further more, the combination lock comprises a flexible and displaceable tongue 15, displaceable in a displacement groove 40, cooperating with a flexible tongue groove 20, of the second connecting device for locking in the vertical direction. Henceforward, the second connecting device will be referred to as a FG-lock. FIG. 1*a*, shows the locking system in a state wherein the combination lock is connected to a third connecting device T of a third panel 3. The third connecting device comprising a locking groove 14 cooperating with the locking element of the combination lock for horizontal locking. Further, the third connecting device comprises a tongue, pushing the flexible tongue of the combination lock into the displacement groove, and cooperating with the displacement groove for locking in the vertical direction. Henceforward, the third connecting device will be referred to as a T-lock FIGS. 1*a-b* show an embodiment with a depth D of the displacement groove 40 equal to the width of the flexible tongue F and the tongue S. A deeper displacement groove is possible, and also a shallower is possible if the properties of the tongue allow compression and/or foiling.

Figure 2:
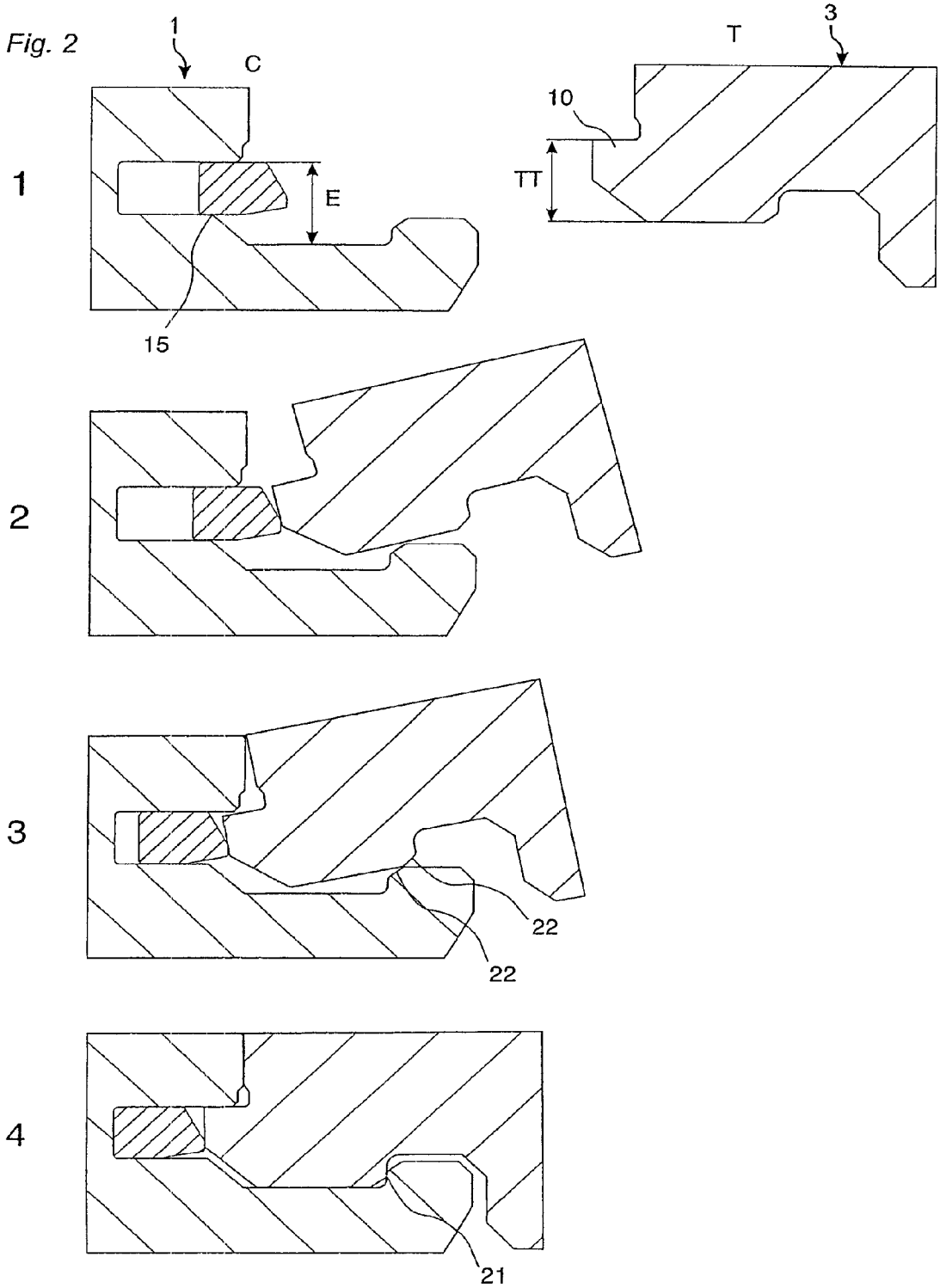
FIG. 2 shows an installation of two panels according to an embodiment of the invention, a tongue side of a panel is connecting a tongue side of an adjacent panel.

FIG. 2 shows in four steps a preferred connection method of the first panel with the combination lock C to the third panel with the T-lock. The panels are connected by angling and the flexible tongue is pushed into the displacement groove. The panels are preferable provided with guiding surfaces 22 which facilitate overcoming the displacement resistance of the flexible tongue. The width of the entrance E of the displacement groove is preferably at least equal to the thickness TT of the tongue. The entrance of the displacement groove is in this relationship defined to start at the joint plane.

Figure 3:
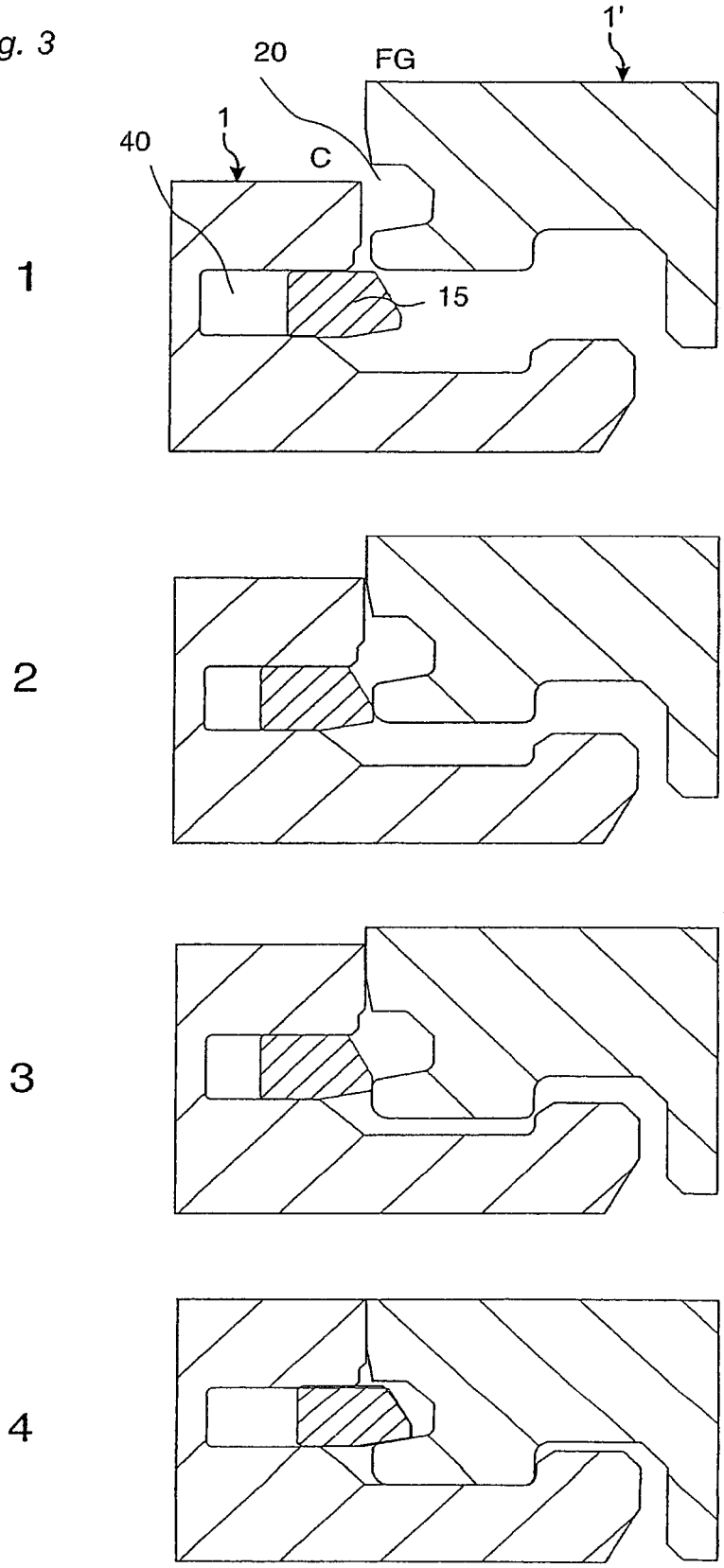
FIG. 3 shows an installation of two panels according to an embodiment of the invention, a tongue side of a panel is connecting a groove side of an adjacent panel.

FIG. 3 shows in four steps a preferred connection method of the first panel with the combination lock C to the second panel with the FG-lock. The panels are connected by folding or solely by vertical movement of the whole panel and the flexible tongue is during the connection pushed into the displacement groove and springs then back into the flexible tongue groove. The panels are preferable provided with guiding surfaces 22 which facilitate overcoming the displacement resistance of the flexible tongue.

A prior art floor panel 1, 1' provided with a mechanical locking system and a displaceable tongue is described with reference to FIGS. 4 and 5. The mechanical locking system provides locking of the panels relative to each other in the vertical direction D1 as well as the horizontal direction D2.

To provide joining of the two joint edges in the D1 and D2 directions, the edges of the floor panel have in a manner known per se a locking strip 6 with a locking element 8 in one joint edge, hereafter referred to as the "strip panel" which cooperates with a locking groove 14 in the other joint edge, hereafter referred to as the "fold panel", and provides the horizontal locking.

The prior art mechanical locking system comprises a separate flexible tongue 15 fixed into a displacement groove 40 formed in one of the joint edges. The flexible tongue 15 has a groove portion P1, which is located in the displacement groove 40 and a projecting portion P2 projecting outside the displacement groove 40. The projecting portion P2 of the flexible tongue 15 in one of the joint edges cooperates with a tongue groove formed in the other joint edge.

The flexible tongue 15 has a protruding part P2 with a rounded outer part 31 and a sliding surface 32, which in this embodiment if formed like a bevel. It has upper 33 and lower 35 tongue displacement surfaces and an inner part 34.

The displacement groove 40 has an upper 42 and a lower 46 opening, which in this embodiment are rounded, a bottom 44 and upper 43 and lower 45 groove displacement surfaces, which preferably are essentially parallel with the horizontal plane HP.

The tongue groove 20 has a tongue-locking surface 22, which cooperates with the flexible tongue 15 and locks the joint edges in a vertical direction D1. The fold panel 1' has a vertical locking surface 24, which is closer to the rear face 62 than the tongue groove 20. The vertical locking surface 24 cooperates with the strip 6 and locks the joint edges in another vertical direction. The fold panel has in this embodiment a sliding surface 23 which cooperated during locking with the sliding surface 32 of the tongue.

Figure 4A:
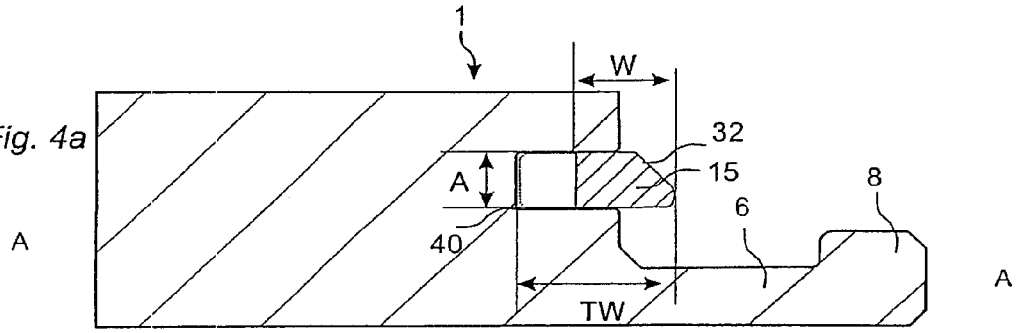
FIGS. 4*a-b* show short sides of two floor panels, according to prior art, with a locking system adapted for vertical folding.
Figure 4B:
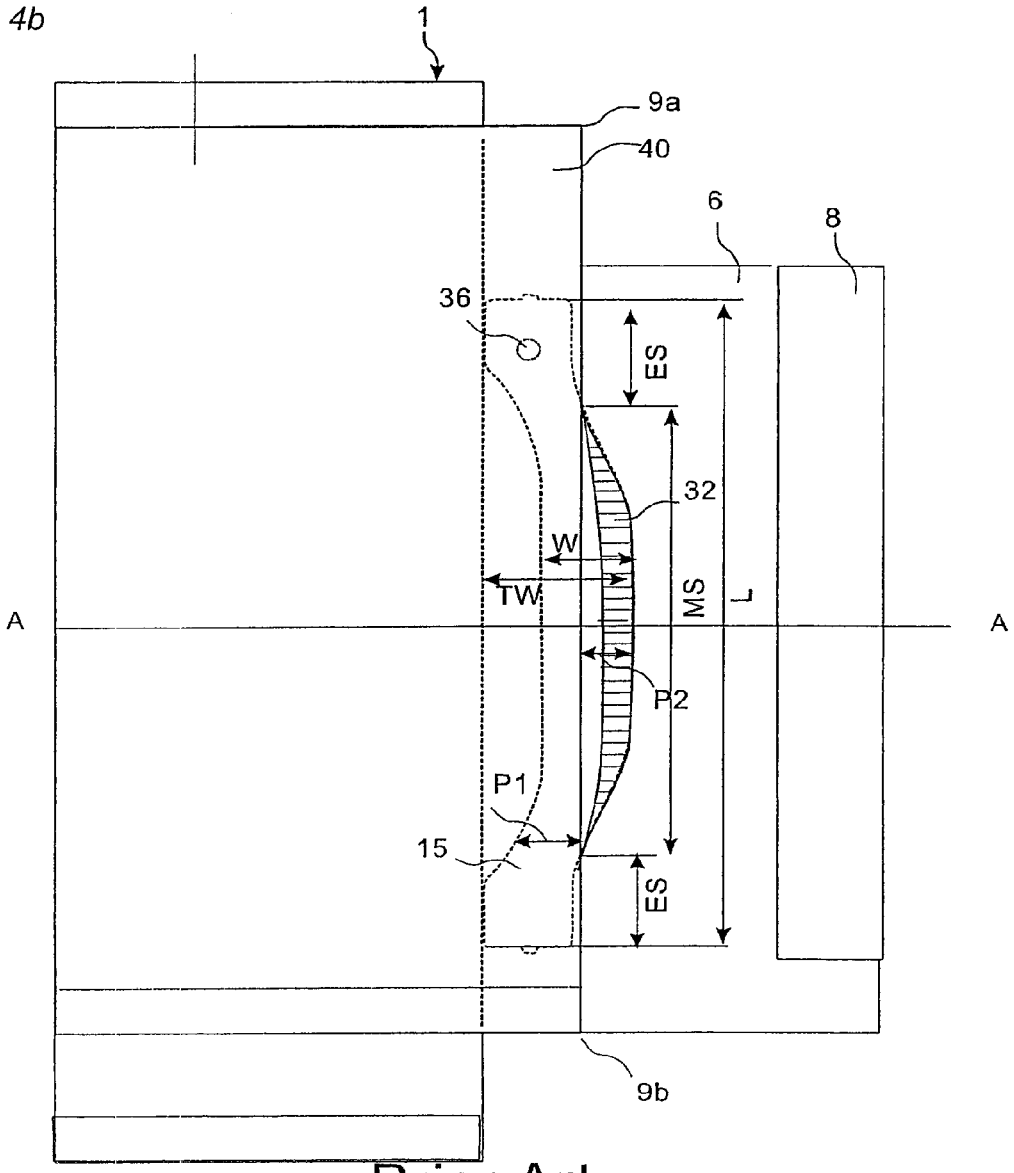

FIG. 4*a* shows a cross section A-A of a panel according to FIG. 4*b* seen from above. The flexible tongue 15 has a length L along the joint edge, a width W parallel to the horizontal plane and perpendicular to the length L and a thickness A in the vertical direction D1. The sum of the largest groove portion P1 and the largest protruding part P2 is the total width TW. The flexible tongue has also in this embodiment a middle section MS and two edge sections ES adjacent to the middle section. The size of the protruding part P2 and the groove portion P1 varies in this embodiment along the length L and the tongue is spaced from the two corner-sections 9*a* and 9*b*. The flexible tongue 15 has on one of the edge sections a friction connection 36 which could be shaped for instance as a local small vertical protrusion. This friction connection keeps the flexible tongue in the displacement groove 40 during installation, or during production, packaging and transport, if the flexible tongue is integrated with the floor panel at the factory.

Figure 5A:
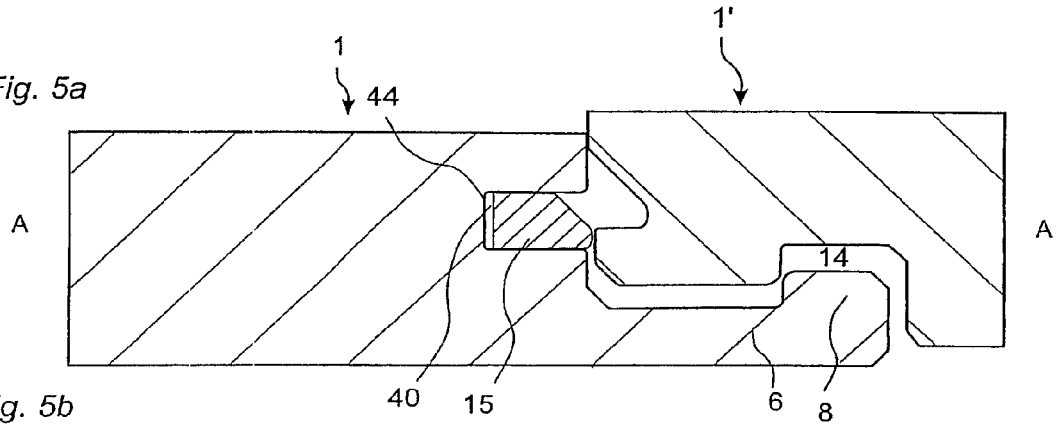
FIGS. 5*a-b* show locking of short sides of two floor panels, according to prior art, with a locking system adapted for vertical folding.
Figure 5B:
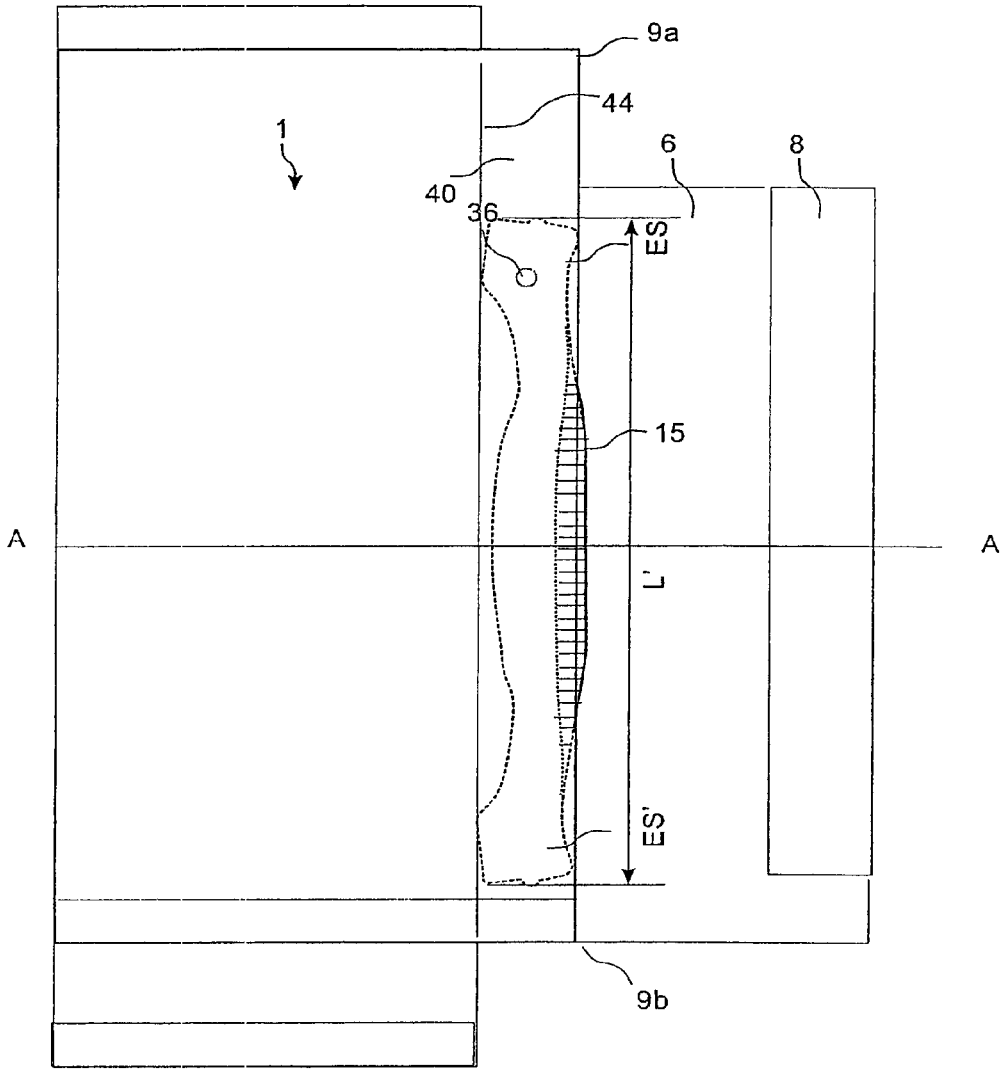

FIGS. 5*a* and 5*b* shows the position of the flexible tongue 15 after the first displacement, during the installation, towards the bottom 44 of the displacement groove 40. The displacement is caused essentially by bending of the flexible tongue 15 in its length direction L parallel to the width W. This feature is essential for this prior art.

Figure 6:
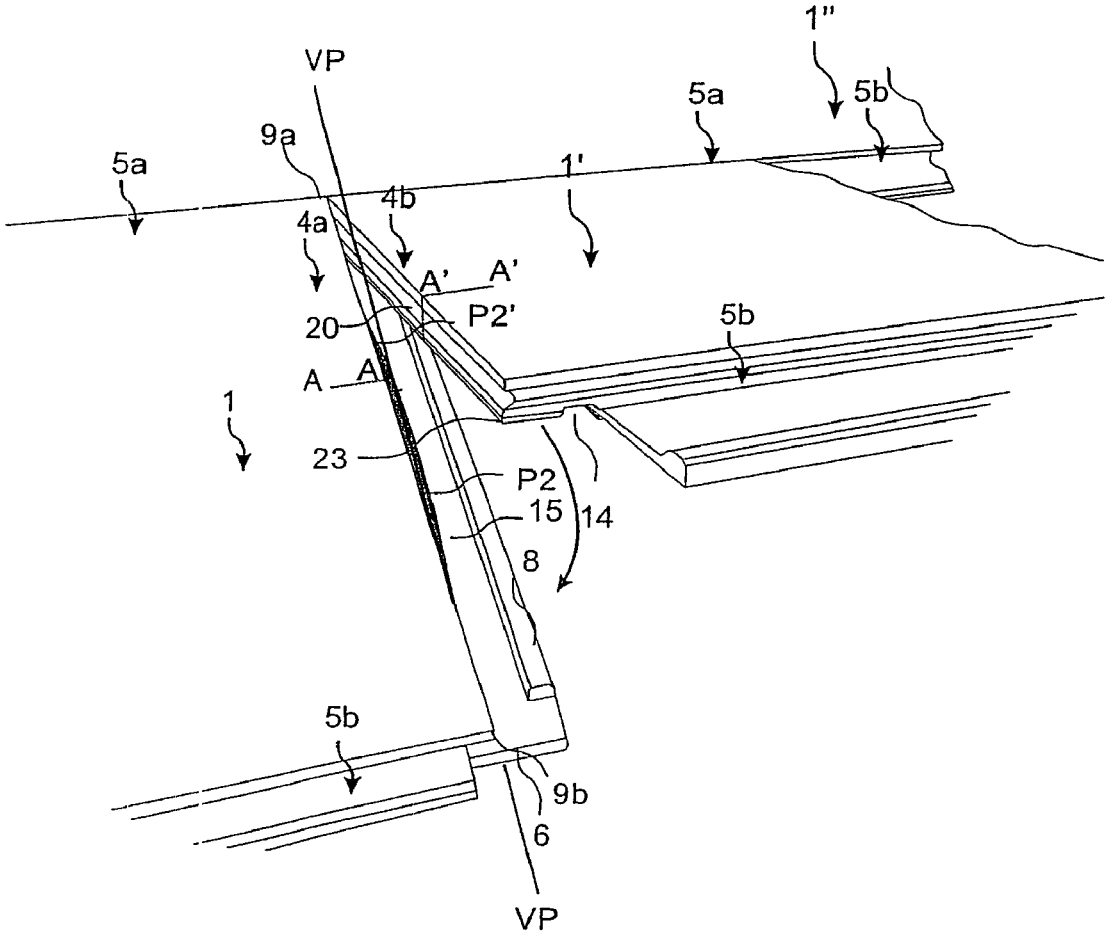
FIG. 6 shows locking with vertical folding in a 3D-view.

FIG. 6 shows one embodiment of a vertical folding. A first panel 1" in a first row is connected to a second 1 panel in a second row. The new panel 1' is connected with its long side 5*a* to the long side 5*b* of the first panel with angling. This angling action also connects the short side 4*b* of the new pane with the short side 4*a* of the second panel. The fold panel 1' is locked to the strip panel 1 with a combined vertical and turning motion along the vertical plane VP. The protruding part P2 has a rounded and or angled folding part P2' which during folding cooperates with the sliding surface 23 of the folding panel 1'. The combined effect of a folding part P2', and a sliding surface 32 of the tongue which during the folding cooperates with the sliding surface 23 of the fold panel 1' facilitates the first displacement of the flexible tongue 15. An essential feature of this embodiment is the position of the projecting portion P2, which is spaced from the corner section 9*a* and 9*b*. The spacing is at least 10% of the length of the joint edge, in this case the visible short side 4*a*.

FIGS. 7*a-e* shows embodiments of the displaceable tongue 15, which are applicable according to the invention, besides the bow shaped tongue shown in FIGS. 4 and 5. Tongues are preferably made of moulded plastic. Any type of polymer materials could be used such as PA (nylon), POM, PC, PP, PET or PE or similar having the properties described above in the different embodiments. These plastic materials could be when injection moulding is used be reinforced with for instance glass fibre, Kevlar fibre, carbon fibre or talk or chalk. A preferred material is glass fibre, preferably extra long, reinforced PP or POM.

Figure 7A:
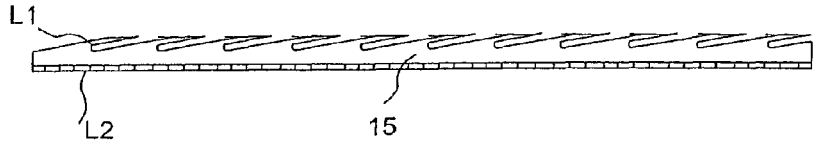
FIGS. 7*a-e* show displaceable tongues in embodiments according to the invention.

FIG. 7*a* shows an embodiment with a first long edge L1 and a second long edge L2. The first long edge has protrusions extending in a plane parallel to the topside 64 of the tongue 15 and with an angle relative the longitudinal direction of the tongue.

Figure 7B:
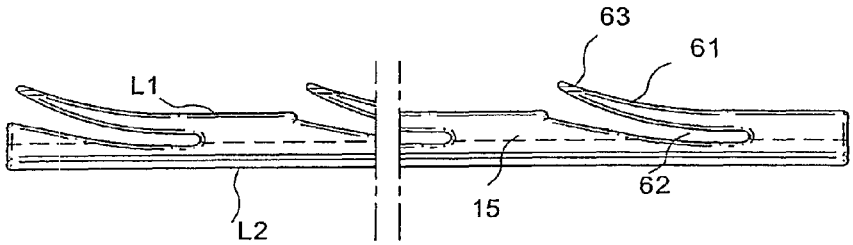

FIGS. 7*a-b* show the embodiment, in top and in a side view, with a first long edge L1 and a second long edge L2. The first long edge has protrusions 61 extending in a plane parallel to the topside, an upper displacement surface 61, and rear side, a lower displacement surface, of the tongue and with an angle relative the longitudinal direction of the tongue. The protrusions are preferably bow shaped and, in a particular preferred embodiment, the tongue is provided with a recess 62 at each protrusion 61. The recess is preferably adapted to the size and shape of the protrusion.

The protrusions are preferably provided with a friction connection 63, most preferably close to or at the tip of the protrusion, which could be shaped for instance as a local small vertical protrusion. This friction connection keeps the flexible tongue in the displacement groove 40 during installation, or during production, packaging and transport, if the displaceable tongue is integrated with the floor panel at the factory.

Figure 7C:
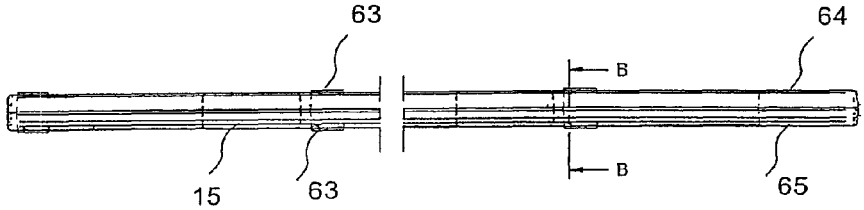
Figure 7D:
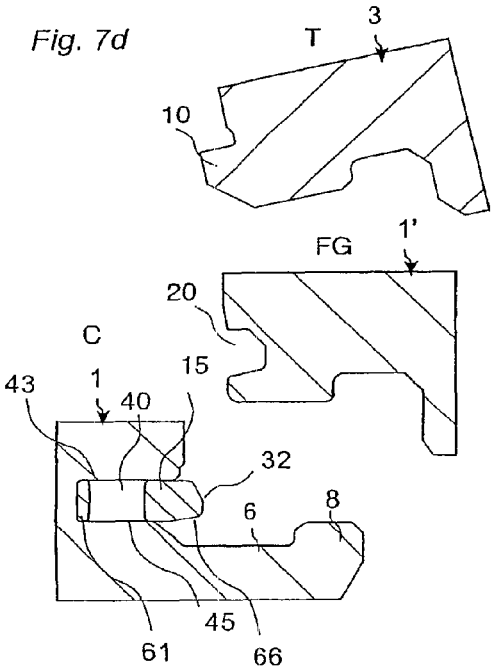

FIG. 7*d* shows one embodiment of the locking system according to the invention illustrating the tongue 15 in the cross section B-B in FIG. 7*c* and positioned in the displacement groove 40 of a first panel 1 with a combination lock C. The upper and lower displacement surface of the tongue is configured to cooperate with an upper 43 and a lower 45 groove displacement surfaces. The panel comprising a locking strip 6 and a locking element 8 for horizontal locking. The panel 1 is configured to be connected to a second panel 1' in a similar way as the shown in FIG. 2 or 3. The upper displacement surface (64) and/or the lower displacement surface (65) of the tongue is in one preferred embodiment provided with a bevelled edge, presenting a sliding surface (32, 31) and an inclined locking surface (66), respectively. The inclined locking surface cooperates preferably with an inclined tongue-locking surface 22 in the tongue groove 20. The combination lock C, may be connected to a second panel 1' provided with the FG-lock or to a third panel provided with the T-Lock.

In the embodiments according to FIG. 7*d*, the displacement groove (40) is formed in one piece with the core of the panel, but other alternatives are possible. The Displacement groove may be formed in a separate material, for example HDF, which is connected to a wood core in a parquet floor. The displacement groove may be formed of U-shaped plastic or metal sections, which are connected to the panel with for example a snap connection, glue or friction. These alternatives could be used to reduce friction and to facilitate horizontal displacement of the tongue in the displacement grove. The displacement groove may also be treated with a friction reducing agent. These principles may also be applied to the tongue groove.

Figure 7E:
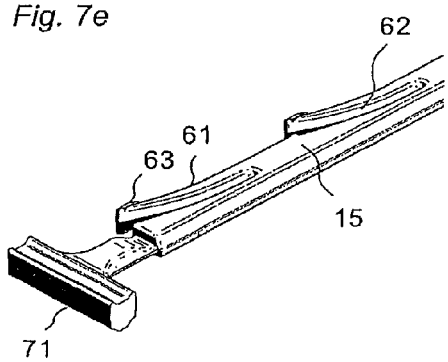

The FIG. 7*e* shows a casting gate 71 which is cut of before insertion into the displacement groove.

Figure 8A:
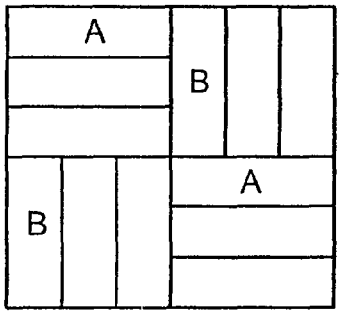
FIGS. 8*a-e* show embodiments of applicable installation patterns.
Figure 8B:
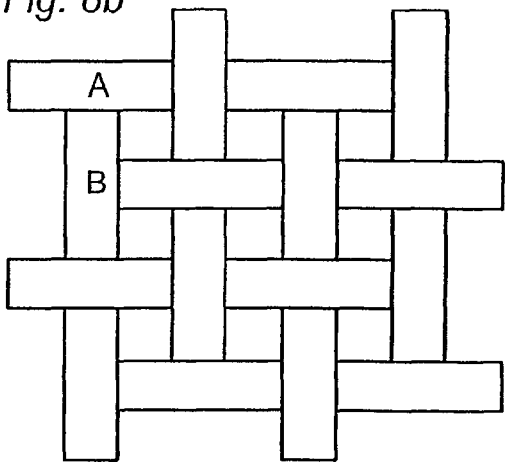
Figure 8C:
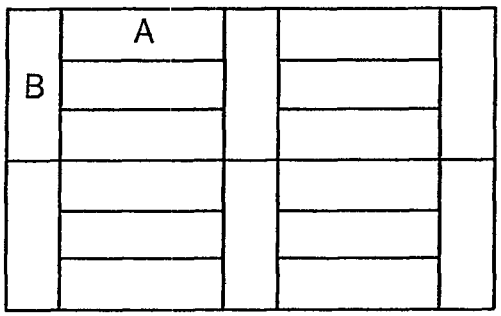
Figure 8D:
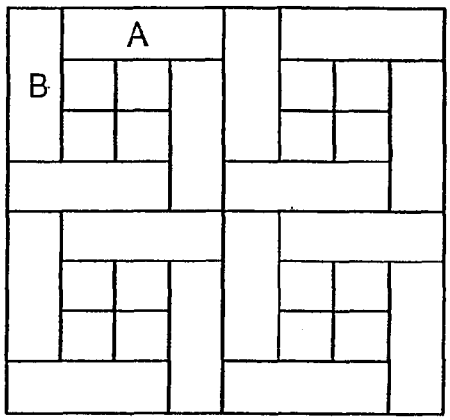
Figure 8E:
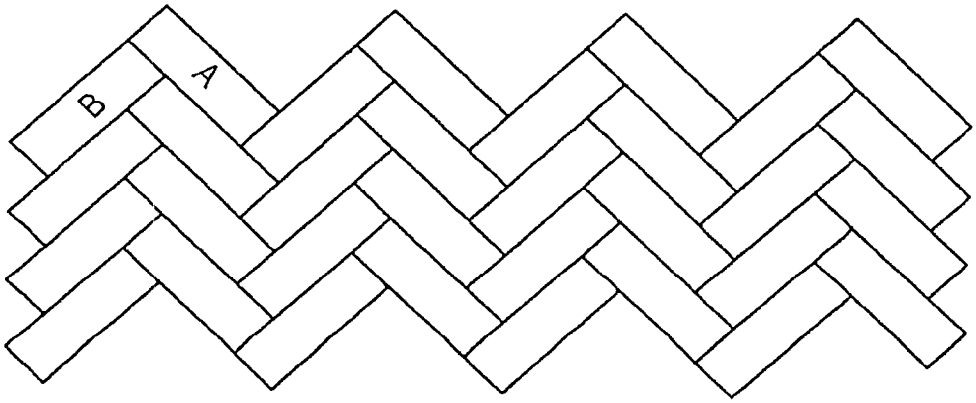

FIGS. 8*a-e* show different installation pattern, which are possible to install with the locking system and set of floor panels according to the invention. FIG. 8*a* shows a pattern with three floor panels connected at the short edges to a long edge of a panel with mirror inverted connecting devices, A and B-panels, which is explained below and in FIGS. 9*a-e*. The pattern consists of a group of three panels in first direction, surrounded by groups of three panels in a perpendicular direction. FIG. 8*b* show a quadratic panel connected at all edges to a long edge of a rectangular. FIG. 8*c* shows a pattern in which a panel in a first direction is connected at an edge to three panels in a second perpendicular direction, which is connected to a first long edge of a fourth panel in the first direction, whose opposite edge is connected to three panels in the second direction, continued in a repeating manner. FIG. 8*d* shows a pattern comprising a group of four connected quadratic panels surrounded and connected to the long edges of rectangular panels. FIG. 8*e* shows a traditional herringbone pattern. All these installation patterns involve connecting of a short side to a long side. The invention provides a solution, which make it possible to install the patterns with a vertical folding method, connecting the panels with a strong joint in the vertical and the horizontal direction. The pattern involves joining of, e.g., (cf. FIGS. 9, 12):

- a short edge provided with a combination lock C to a long edge provided with the T-lock
- a short edge provided with the FG-lock to a long edge provided with the combination lock C
- a long edge provided with the combination lock C to a long edge with the T-lock
- a short edge provided with the FG-lock to a short edge provided with the combination lock C
- an edge of a quadratic panel provided with a combination lock C to another edge of a quadratic panel provided with the T-lock
- an edge of a quadratic panel provided with a combination lock C to another edge of a quadratic panel provided with the FG-lock
- an edge of a quadratic panel provided with a combination lock C to a long edge provided with the FG-lock
- an edge of a quadratic panel provided with a combination lock C to a long edge provided with the T-lock
- an edge of a quadratic panel provided with a FG-lock to a long edge provided with the combination lock C
- an edge of a quadratic panel provided with a T-lock to a long edge provided with the combination lock C The short edge of an A-panel are preferably joined to the long edge of a B-panel, as is common for installation with A and B-panels.

Figure 9A:
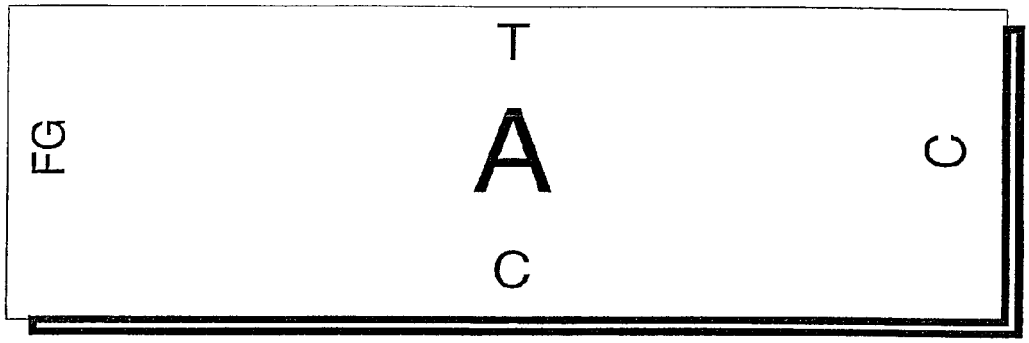
FIGS. 9*a-d* show embodiments of the locking system of the invention applied to rectangular and square A and B panels.
Figure 9B:
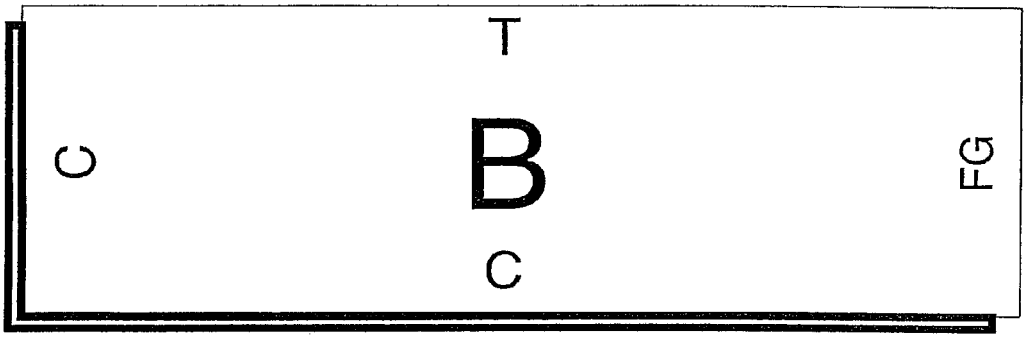
Figure 9C:
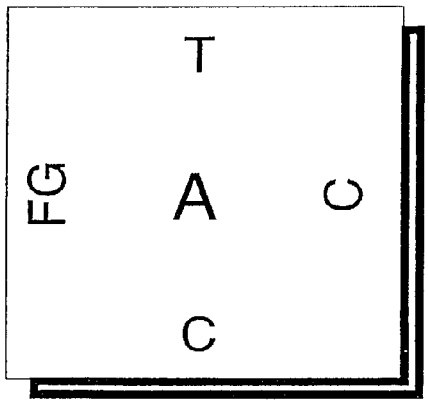
Figure 9D:
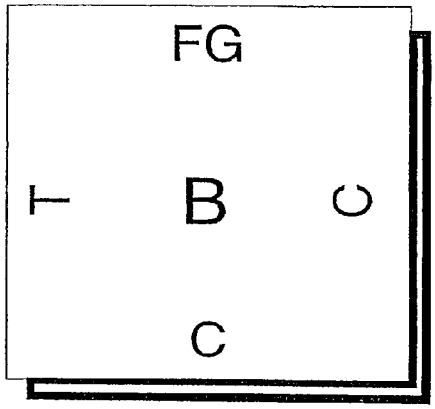

One way to enable connecting of a short side to a long side is to provide A-panels and B-panels with mirror inverted connecting devices, as is shown in FIGS. 9*a-d*. Two adjacent edges of the panels are provided with the combination lock C, one edge with the FG-Lock and one edge provided with the T-lock. The three types of connecting devices C, FG, T are distributed mirror inverted on the A and on the B panel. FIG. 9*a* shows a rectangular A-panel with long and short edges. FIG. 9*b* shows a rectangular B-panel with long and short edges. FIG. 9*a* shows a quadratic A-panel and 9*b* shows a quadratic B-panel.

Figure 10A:
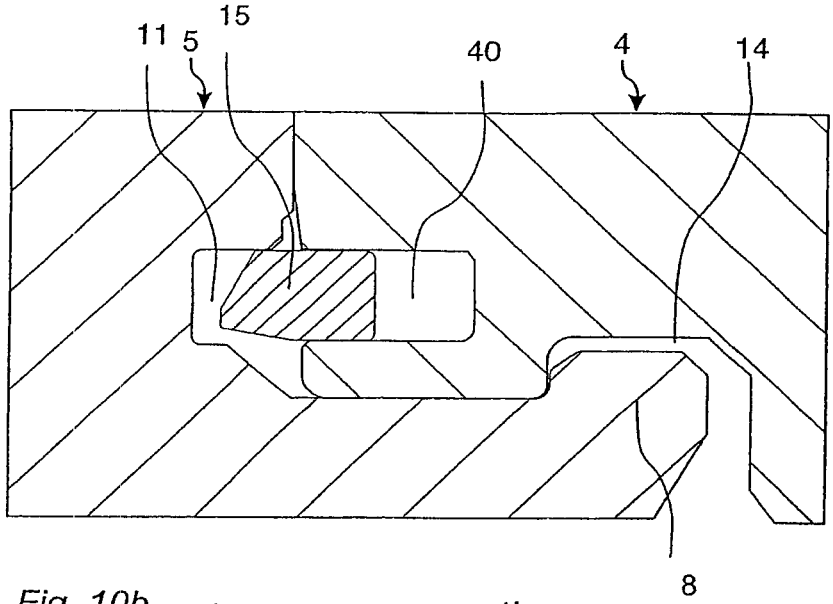
FIG. 10*a* shows a prior art locking system.

FIG. 10*a* shows an embodiment wherein a displaceable flexible tongue 15 and a displacement groove 40 is provided on fourth connecting device on a fourth panel 4 comprising a locking groove 14. This makes it possible to connect a short side, with the fourth connecting device, of a floor panel 4 to a long side of fifth panel 5 comprising a standard connecting device, comprising locking element 8 and tongue groove 11 for connection by angling, with vertical folding. The problem is that this solution creates a thin section between the bottom of the displacement groove 40 and the locking groove 14, resulting in a weak joint.

Figure 10B:
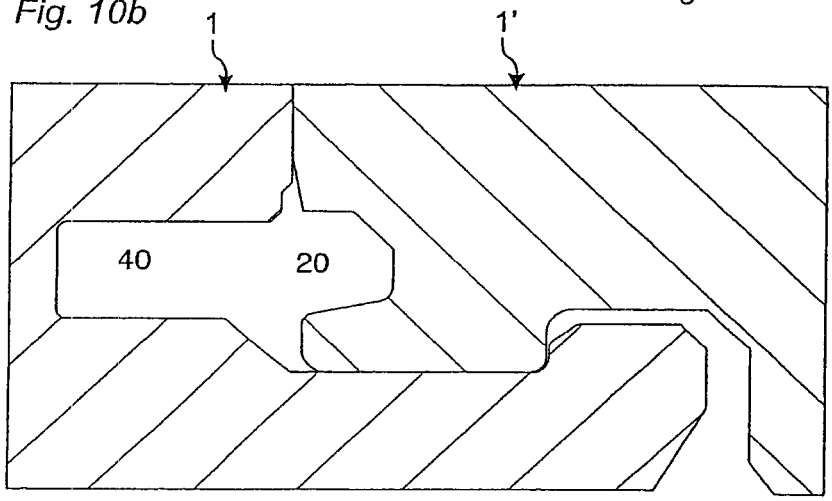
FIGS. 10*b-d* show embodiments of the locking system according to the invention.

FIG. 10*b* shows an embodiment wherein the flexible tongue is removed and the joint is only locking in the horizontal direction.

Figure 10C:
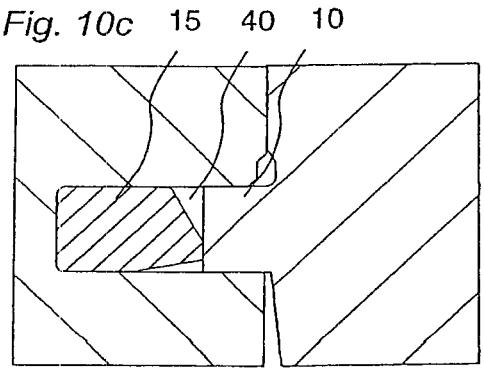
Figure 10D:
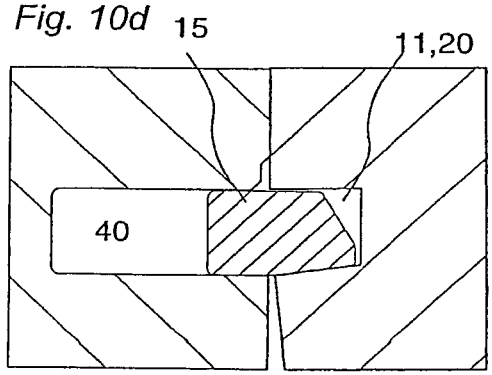

FIGS. 10*c-d* show how the principles of the invention may be applied to tongue-groove joint, without any horizontally locking. FIG. 10*c* illustrates a panel with a flexible tongue 15 and a displacement groove 40 cooperating with a tongue 10 of a tongue panel. FIG. 10*d* illustrates a groove panel with a flexible tongue groove 20 cooperating with the flexible tongue 15. The groove panel may be connected also to a tongue panel with a tongue cooperating with the groove 11.

Figure 11:
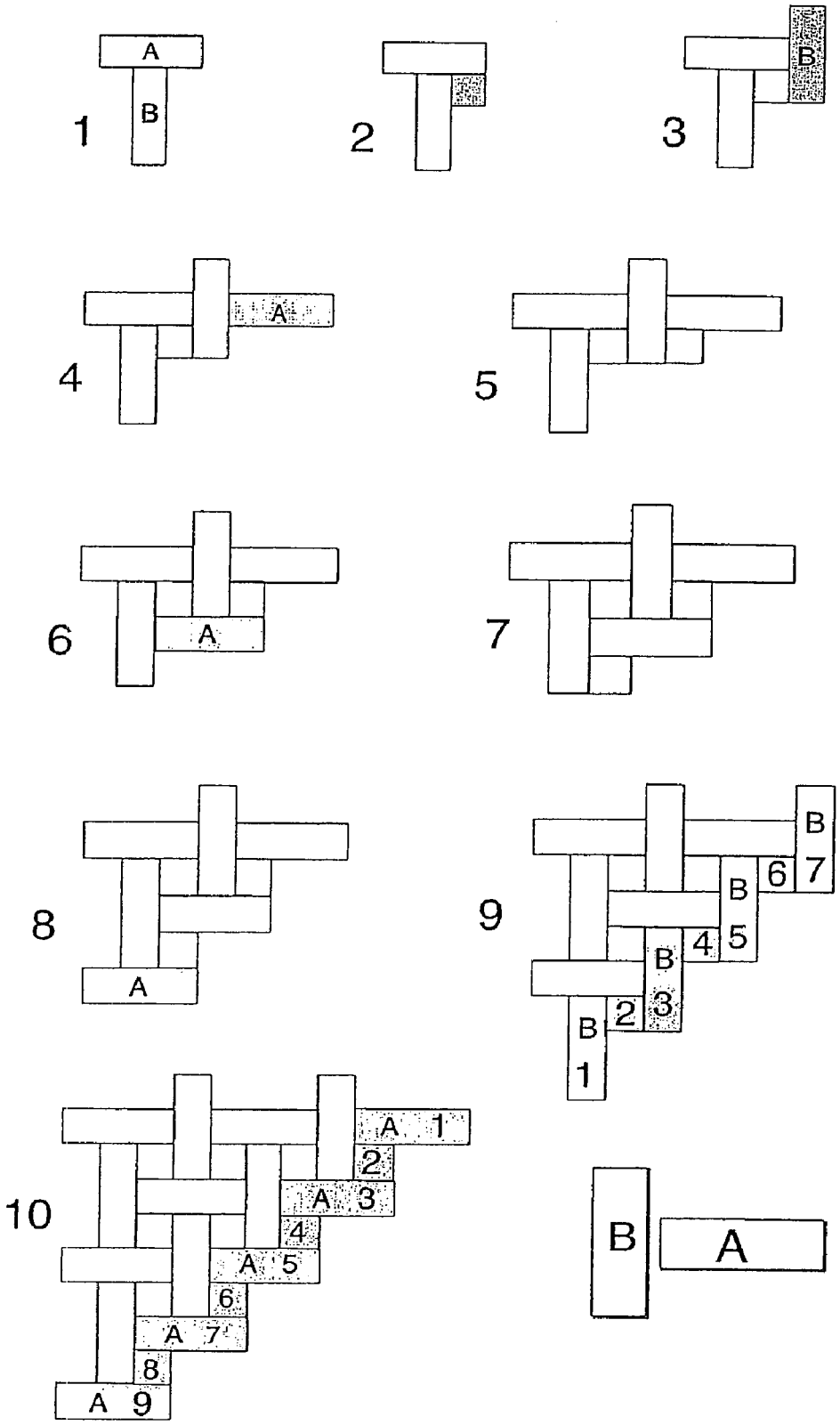
FIG. 11 shows an installation of panels in a pattern, comprising A, B and square panels for which the locking system of the invention is applicable.

FIG. 11 shows in 10 steps a preferred connection method of A and B-panels, quadratic and with long and short edges in an advanced pattern. Short edges are joined to long edges and the quadratic panels are at all edges joined with long edges.

Figure 12A:
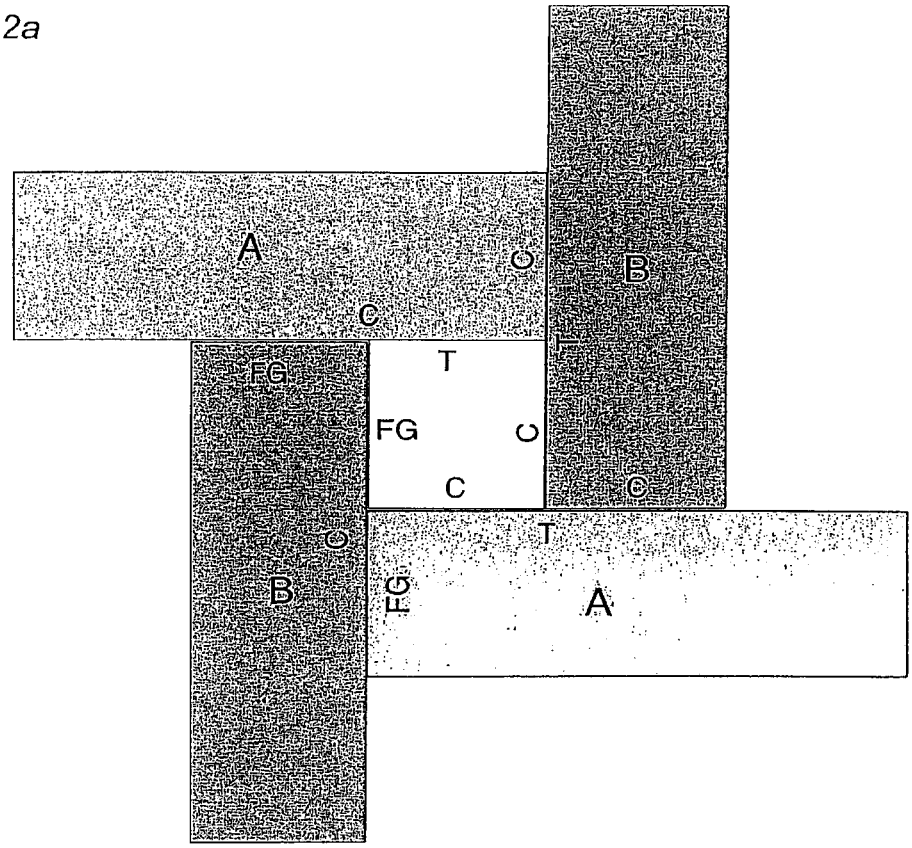
FIGS. 12*a-b* shows an embodiment of a combination of locking system, comprising rectangular and quadratic A and B panels for which the locking system of the invention is applicable.

FIG. 12*a* shows an enlarged part of the pattern in FIG. 11 and how the combination loc is distributed to generate the A and B-panels and to enable the pattern.

Figure 12B:
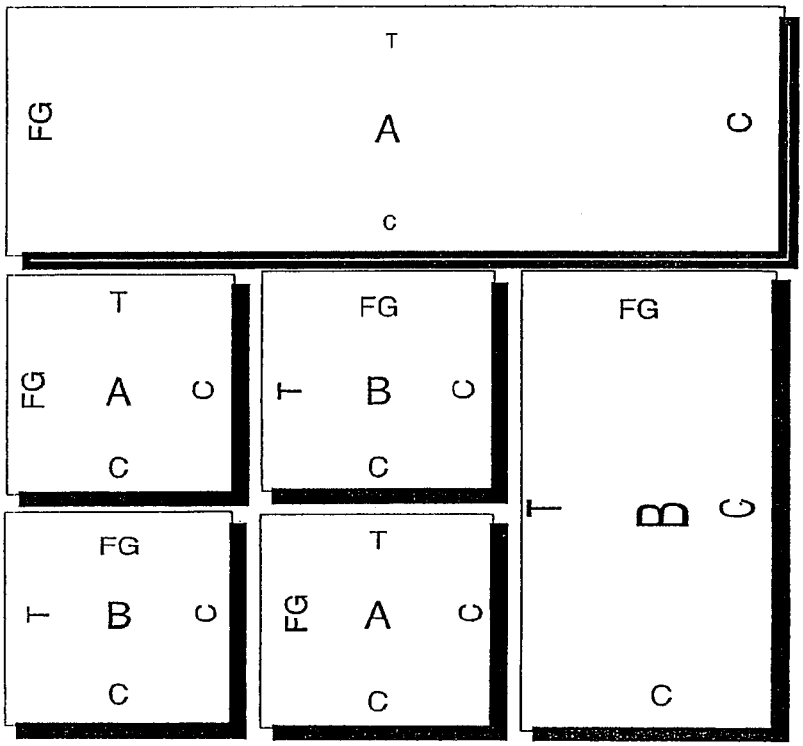

FIG. 12*b* shows how the combination loc is distributed to generate the quadratic A and B-panels. The panels are connected in manner avoiding a row with several CFG-joints, which is a joint between a combination lock against to a FG-lock, in a line. This is an advantage, since a CT-joint, which is a joint between the combination loc C to a T-lock, offers a stronger connection in the vertical direction. Consequently it is preferred that every second joint in a line is a CFG-joint and provided there between is a CT-joint. The figure also shows an embodiment of the distribution of the connecting devices to provide, which make it possible to connect several quadratic panels to a long edges of a rectangular panel. Several edges of the quadratic panels with the combination lock may be connected to a long edge with the T-lock. Quadratic panels, with edges in a line having the FG-lock and the T-lock, may be connected to a long edge with the combination lock C.

A disadvantage with the CT-joint is that the flexible tongue pushes the panels apart and possible causing a gap between the panels. One solution to avoid this is to adapt the stiffness of the flexible tongue, so that the force pushing the panels apart is reduced, but this also influence the final position in a CFG-joint. A second solution is that the flexible tongue is configured to be cracked or destroyed when the tongue pushes it into the displacement groove. A third solution is a strong locking element with guiding surfaces, facilitating the installation. A fourth solution is to dissolve or remove the tongue. It is also possible to provide the joint edges with bevels or decorative grooves, which hidden the gap.

The invention is not restricted to the above-mentioned illustrative embodiments, but is naturally applicable to other embodiments within the scope of the following patent claims, and equivalents thereof.

The invention claimed is:

1. A locking system for a floor panel comprising:

a first connecting device comprising an integrated combination lock at a first edge of a first floor panel, the combination lock configured to connect the first floor panel to a another floor panel, so that upper joint edges of the floor panels in the connected state define a vertical plane, the combination lock comprising a flexible tongue in a displacement groove, the flexible tongue configured to cooperate with a tongue groove of a second connecting device at the edge of a second floor panel for connecting the first and the second floor panel together in a vertical direction parallel to the vertical plane, and the displacement groove and the flexible tongue of the combination lock are configured to cooperate with a tongue of a third connecting device at the edge of a third panel, for connecting the first panel and the third panels in the vertical direction parallel to the vertical plane, the flexible tongue being displaceable via the tongue of the third panel and positioned, in a connected position of the first and the third panel, via the tongue inside the joint edge of the first panel and inside the displacement groove.

2. The locking system as claimed in claim 1, wherein the depth of the displacement groove is at least equal to the sum of the width of the flexible tongue and the width of the tongue of the third panel.

3. The locking system as claimed in claim 2, wherein width of the entrance of the displacement groove is preferably at least equal to the thickness of the tongue.

4. The locking system as claimed in claim 1, wherein width of the entrance of the displacement groove is preferably at least equal to the thickness of the tongue.

* * * * *

UNITED STATES PATENT AND TRADEMARK OFFICE

CERTIFICATE OF CORRECTION

PATENT NO. : 7,721,503 B2
APPLICATION NO. : 11/822710
DATED : May 25, 2010
INVENTOR(S) : Darko Pervan et al.

It is certified that error appears in the above-identified patent and that said Letters Patent is hereby corrected as shown below:

Title page under Related U.S. Application Data Item (63), please add:

--Continuation of Application No. 11/770,771, filed June 29, 2007--

Signed and Sealed this

Seventeenth Day of August, 2010

David J. Kappos

David J. Kappos
*Director of the United States Patent and Trademark Office*